US008434443B2

(12) United States Patent
Lykowski et al.

(10) Patent No.: US 8,434,443 B2
(45) Date of Patent: May 7, 2013

(54) IGNITER SYSTEM FOR IGNITING FUEL

(75) Inventors: James D. Lykowski, Temperance, MI (US); William J. Walker, Toledo, OH (US); John W. Hoffman, Perrysburg, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 300 days.

(21) Appl. No.: 12/686,251

(22) Filed: Jan. 12, 2010

(65) Prior Publication Data

US 2010/0175655 A1 Jul. 15, 2010

Related U.S. Application Data

(60) Provisional application No. 61/143,916, filed on Jan. 12, 2009.

(51) Int. Cl.
*H01T 13/54* (2006.01)
*H01T 13/60* (2011.01)

(52) U.S. Cl.
USPC ..... 123/169 R; 123/145 A

(58) Field of Classification Search ..... 123/169 R, 123/143 C, 143 B, 145 A, 606; 313/138
See application file for complete search history.

(56) References Cited

U.S. PATENT DOCUMENTS

| | | | | |
|---|---|---|---|---|
| 3,149,620 | A * | 9/1964 | Cataldo | 123/146.5 A |
| 3,842,818 | A | 10/1974 | Cowell et al. | |
| 3,974,412 | A * | 8/1976 | Pratt, Jr. | 313/131 R |
| 4,464,192 | A | 8/1984 | Layden et al. | |
| 4,717,986 | A | 1/1988 | Collins, Jr. et al. | |
| 4,841,925 | A | 6/1989 | Ward | |
| 5,361,737 | A | 11/1994 | Smith et al. | |
| 5,471,362 | A | 11/1995 | Gowan | |
| 5,549,795 | A * | 8/1996 | Gregoire et al. | 204/164 |
| 5,555,862 | A | 9/1996 | Tozzi | |
| 5,619,959 | A | 4/1997 | Tozzi | |
| 5,649,507 | A * | 7/1997 | Gregoire et al. | 123/143 B |
| 5,704,321 | A | 1/1998 | Suckewer et al. | |
| 5,760,532 | A * | 6/1998 | Makoto et al. | 313/130 |
| 5,811,761 | A | 9/1998 | Kita et al. | |
| 6,035,838 | A | 3/2000 | Tozzi et al. | |
| 6,095,124 | A | 8/2000 | Matsubara et al. | |
| 6,131,542 | A | 10/2000 | Suckewer et al. | |
| 6,131,555 | A | 10/2000 | Tozzi et al. | |
| 6,227,157 | B1 | 5/2001 | Baumgartner et al. | |
| 6,321,733 | B1 | 11/2001 | Suckewer et al. | |
| 6,366,008 | B1 | 4/2002 | Fukushima et al. | |
| 6,391,171 | B1 | 5/2002 | Lommasson | |
| 6,688,932 | B2 | 2/2004 | Nasu et al. | |
| 6,883,507 | B2 | 4/2005 | Freen | |
| 7,449,824 | B2 | 11/2008 | Moribe et al. | |
| 2002/0041137 | A1 | 4/2002 | Nishikawa | |
| 2008/0141967 | A1 | 6/2008 | Tani et al. | |

FOREIGN PATENT DOCUMENTS

| | | | |
|---|---|---|---|
| FR | 2859831 | A1 | 9/2003 |
| JP | 04-286890 | A | 10/1992 |
| JP | 2008-171570 | A | 7/2008 |
| KR | 1019990053670 | A | 7/1999 |

* cited by examiner

*Primary Examiner* — Mahmoud Gimie
(74) *Attorney, Agent, or Firm* — Robert L. Stearns; Dickinson Wright, PLLC

(57) ABSTRACT

This invention provides a corona discharge fuel igniter system and methods for igniting fuel in an internal combustion engine. A ceramic dielectric material is provided that significantly increases the efficiency of corona discharge to ignite the fuel in an internal combustion engine.

26 Claims, 5 Drawing Sheets

IGNITER SYSTEM FOR IGNITING FUEL

CROSS REFERENCE TO RELATED APPLICATIONS

This application is based upon and claims the benefit under 35 U.S.C. §119(e) of U.S. Provisional Patent Application Ser. No. 61/143,916, filed Jan. 12, 2009, which is incorporated herein by reference in its entirety for all purposes.

FIELD OF THE INVENTION

This invention relates to a corona discharge fuel igniter system. The invention further relates to a method for igniting fuel in an internal combustion engine.

BACKGROUND OF THE INVENTION

A number of different ignition systems for igniting fuel in internal combustion systems has been proposed. These ignition systems generally fall into three main types: conventional arc discharge, classic plasma discharge, and corona discharge.

In a conventional arc or inductive ignition system, an ignition coil is charged on a primary winding with a DC voltage, and a finite quantity of energy is stored in the ignition coil. At some predefined ignition point, the current flow to the primary winding of the ignition coil is turned off, and a portion of the energy stored in the ignition coil is discharged from a secondary winding of the ignition coil across a spark gap of a spark plug to ground. In this discharge, the voltage at the spark plug gap increases until the potential is large enough to create an arc across the spark plug electrodes to ground. The stored energy from the ignition coil is quickly discharged through the arc to ground in a single discharge event, until the energy is dissipated to the point to which it can no longer sustain the arc. In this type of ignition system, the current in the arc during the discharge event is limited to a moderate level by the relatively high resistance in the secondary circuit, and the arc voltage is relatively low. The arc itself is highly ionized and has relatively low resistance to ground.

In a classic plasma ignition system there is generally an additional capacitive energy storage that is used to significantly increase the energy stored before discharge across a spark gap. In this system, a capacitor is typically not high enough voltage to initiate an arc across the spark gap, so a conventional inductive ignition coil system is used to initiate the discharge path. Once a discharge path is established, the energy stored in the capacitor can be discharged extremely rapidly in a high current burst of energy and at a relatively low voltage. This fast, high energy discharge creates a visible plasma in a single discharge. Once the energy is dissipated from both the ignition coil and from the capacitor, an arc and plasma go out and the event is over.

U.S. Patent Pub. No. 2008/0141967 (Tani) is an example of a classic plasma ignition system. This patent publication discloses a plasma ignition device that includes a plasma ignition plug having an alumina insulation member to insulate a center electrode from a ground electrode, and electric power supply circuits to apply high voltages to the plasma ignition plug. The plasma ignition device activates the gas in a discharge space of the insulation member into the plasma of a high temperature and a high pressure by the high voltage applied between the center electrode and the ground electrode and injects the same into an internal combustion engine. The electric power supply circuits are connected to the center electrode as an anode and to the ground electrode as a cathode.

A corona discharge system typically does not include a stored energy device. As a result, energy is not discharged in a single event. A conventional spark ignition produces a fixed duration ignition event. A corona ignition device can produce an ignition event for a controlled period of time.

U.S. Pat. No. 6,883,507 (Freen) discloses an example of a corona discharge system. The system comprises an electrode inside of a combustion chamber, an electric circuit which provides radio frequency electric power to the electrode, and a ground formed by the combustion chamber walls. A radio frequency voltage differential formed between the electrode and the ground produces a radio frequency electric field therebetween, which creates a non-thermal plasma, resulting in combustion of the fuel-air mixture. A boron nitride insulator surrounds the electrode. The system can be utilized in engines such as internal combustion engines or gas turbine engines.

More efficient igniter systems for igniting fuel in internal combustion engines are needed. In particular, igniter systems that provide highly effective dielectric and mechanical properties under the extreme temperature, mechanical stress and pressure conditions of the combustion environment are desired.

SUMMARY OF THE INVENTION

This invention provides a corona discharge fuel igniter system and method for igniting fuel in an internal combustion engine that is highly efficient at corona discharge. In addition, the invention provides a system that is capable of long term operation under the extreme temperature, mechanical stress and pressure conditions of the combustion environment.

According to one aspect of the invention there is provided a corona discharge fuel igniter system, i.e., device. The system has an electrical connector end and a corona discharge end. There is an electrical conductor connecting the electrical connector end to the corona discharge end and an inductor assembly connected to the electrical conductor at the electrical connector end. The system preferably includes a non-ceramic dielectric material surrounding the electrical conductor and inductor assembly at the electrical connector end, and a ceramic dielectric material in contact with the non-ceramic dielectric material that surrounds the electrical conductor at the corona discharge end.

In an preferred embodiment, the inductor assembly includes at least one inductor. Preferably, the inductor assembly includes resistance and inductance elements. Alternatively, the inductor assembly includes resistance, inductance and capacitance elements.

In one embodiment, the ceramic dielectric material has a dielectric constant different from that of the non-ceramic dielectric material. Preferably, the ceramic dielectric material is a sintered inorganic, nonmetallic material comprised of compounds formed between at least one metallic and one nonmetallic element or compounds of at least two different nonmetallic elements.

In another embodiment of the invention, the ceramic dielectric material is comprised of at least one oxide or nitride of aluminum or silicon. In a preferred embodiment, the ceramic dielectric material is comprised of alumina and silica.

In yet another embodiment, the ceramic dielectric material is comprised of not greater than not greater than 5 wt % of at least one oxide of calcium, magnesium, zirconium or boron. Preferably, the non-ceramic dielectric material is comprised of at least one gas, resin or polymer dielectric material. In general, the non-ceramic dielectric material has a dielectric constant different from that of the ceramic dielectric material.

According to another aspect of the invention, there is provided a method for igniting fuel in an internal combustion engine. The method comprises providing electrical current to a corona discharge fuel igniter system and passing at least a portion of the electrical current through the fuel igniter system in the form of radio frequency voltage by way of an electrical conductor in the fuel igniter system. At least a portion of the electrical conductor is surrounded with a ceramic dielectric material comprised of at least one oxide or nitride of aluminum or silicon as the current passes through the conductor, and a corona discharge is emitted from the fuel igniter system to ignite the fuel in the internal combustion engine.

In one embodiment, radio frequency voltage is provided as the electrical current. Preferably, at least a portion of the conductor is surrounded by a non-ceramic dielectric material that connects to the ceramic dielectric material.

DETAILED DESCRIPTION OF THE INVENTION

Figure 1A:
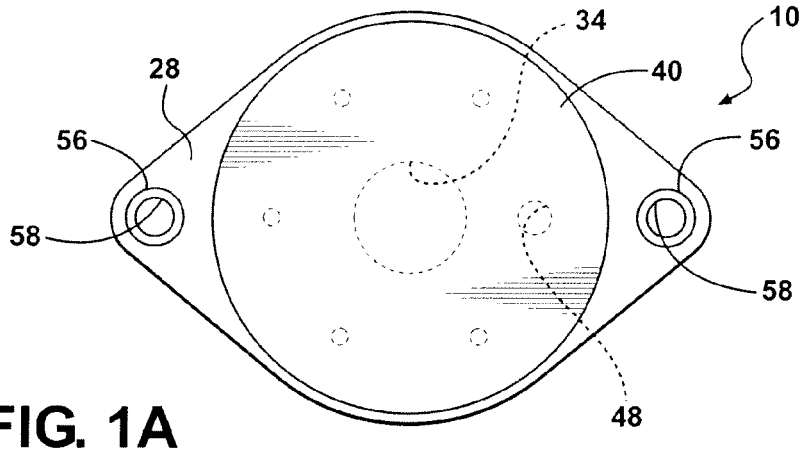
FIGS. 1A and 1B show a top view and a cross-sectional view of an igniter system fabricated according to an embodiment of the invention.
Figure 1B:
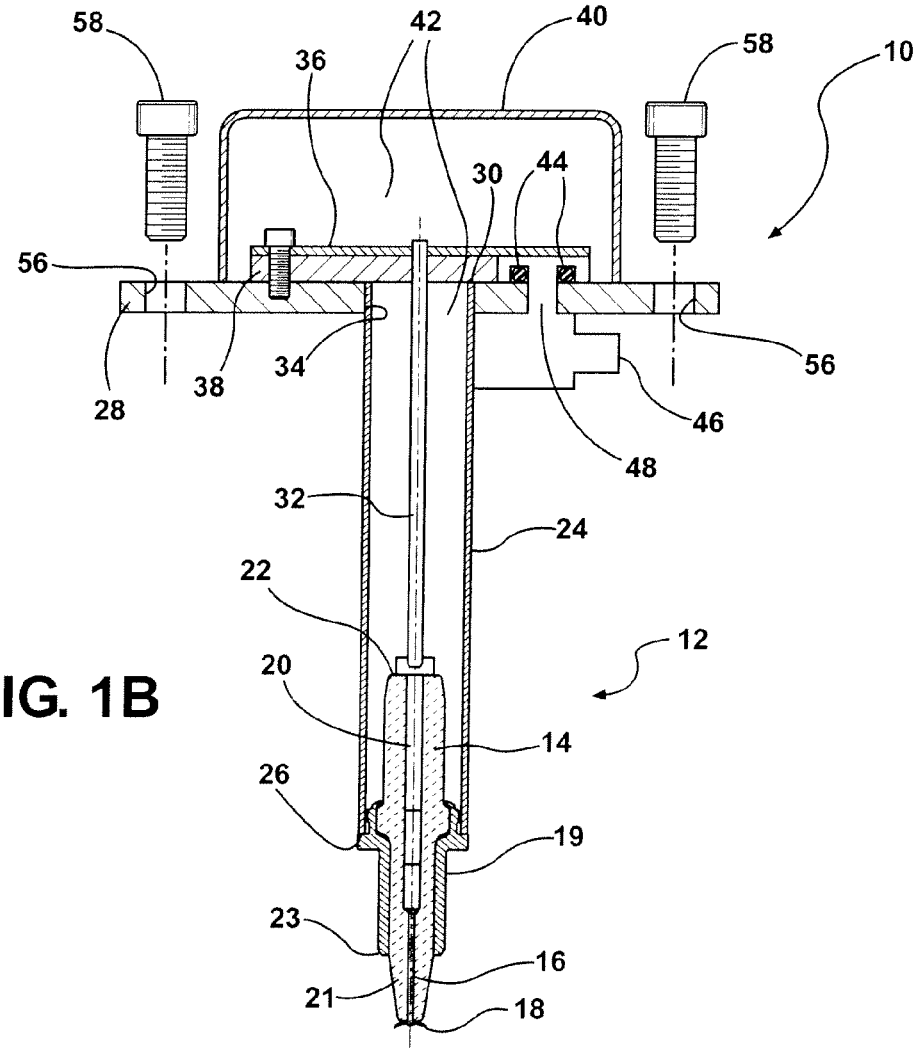
Figure 2:
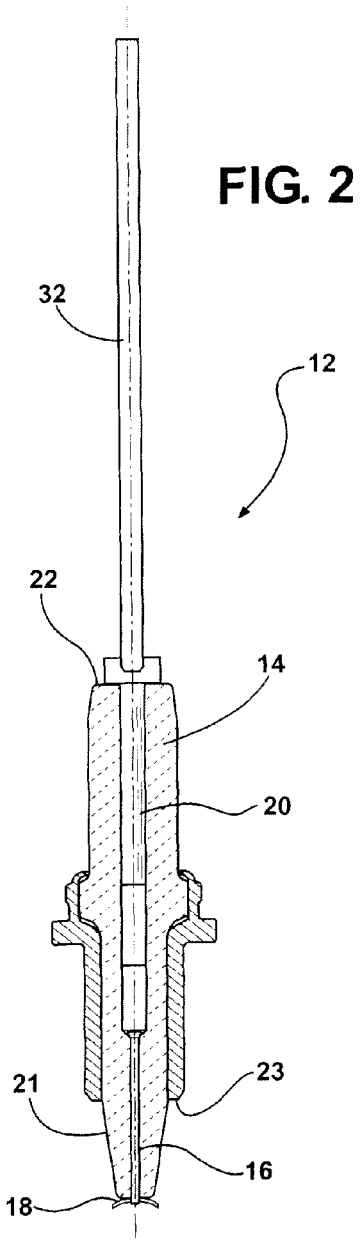
FIG. 2 is a view of the corona discharge assembly portion of the igniter.
Figure 3:
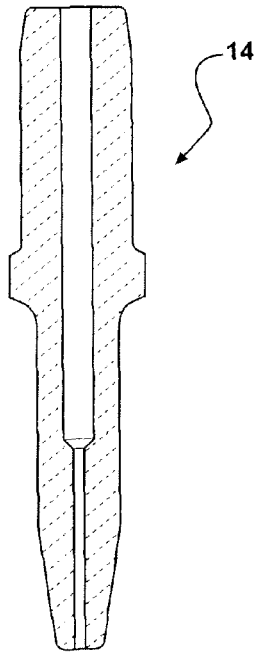
FIG. 3 is a view of the insulator.
Figure 4:
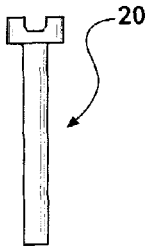
FIG. 4 is a view of the terminal.
Figure 5:
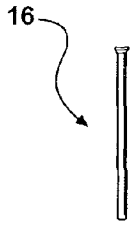
FIG. 5 is a view of the electrode wire.
Figure 6:
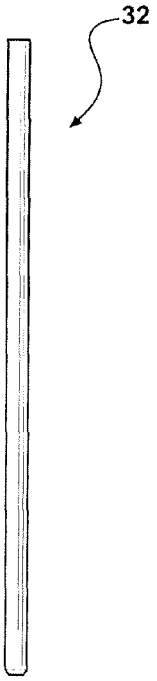
FIG. 6 is a view of the connecting wire.
Figure 7A:
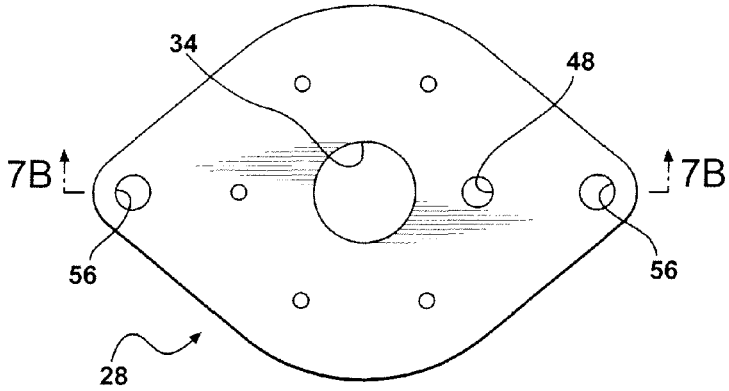
FIGS. 7A and 7B show a top view and cross-sectional view of the flange.
Figure 7B:
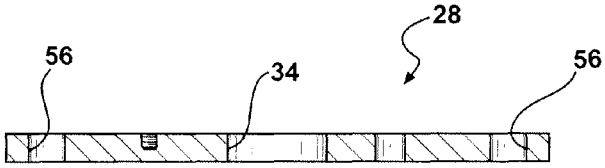
Figure 8:
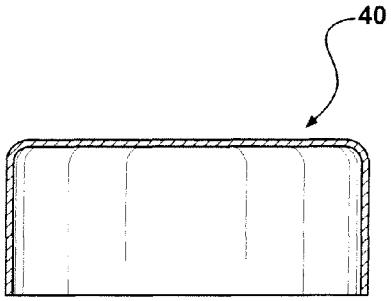
FIG. 8 is a view of the cover.
Figure 9:
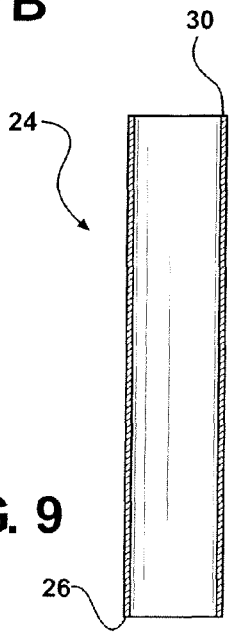
FIG. 9 is a view of the tube.
Figure 10:
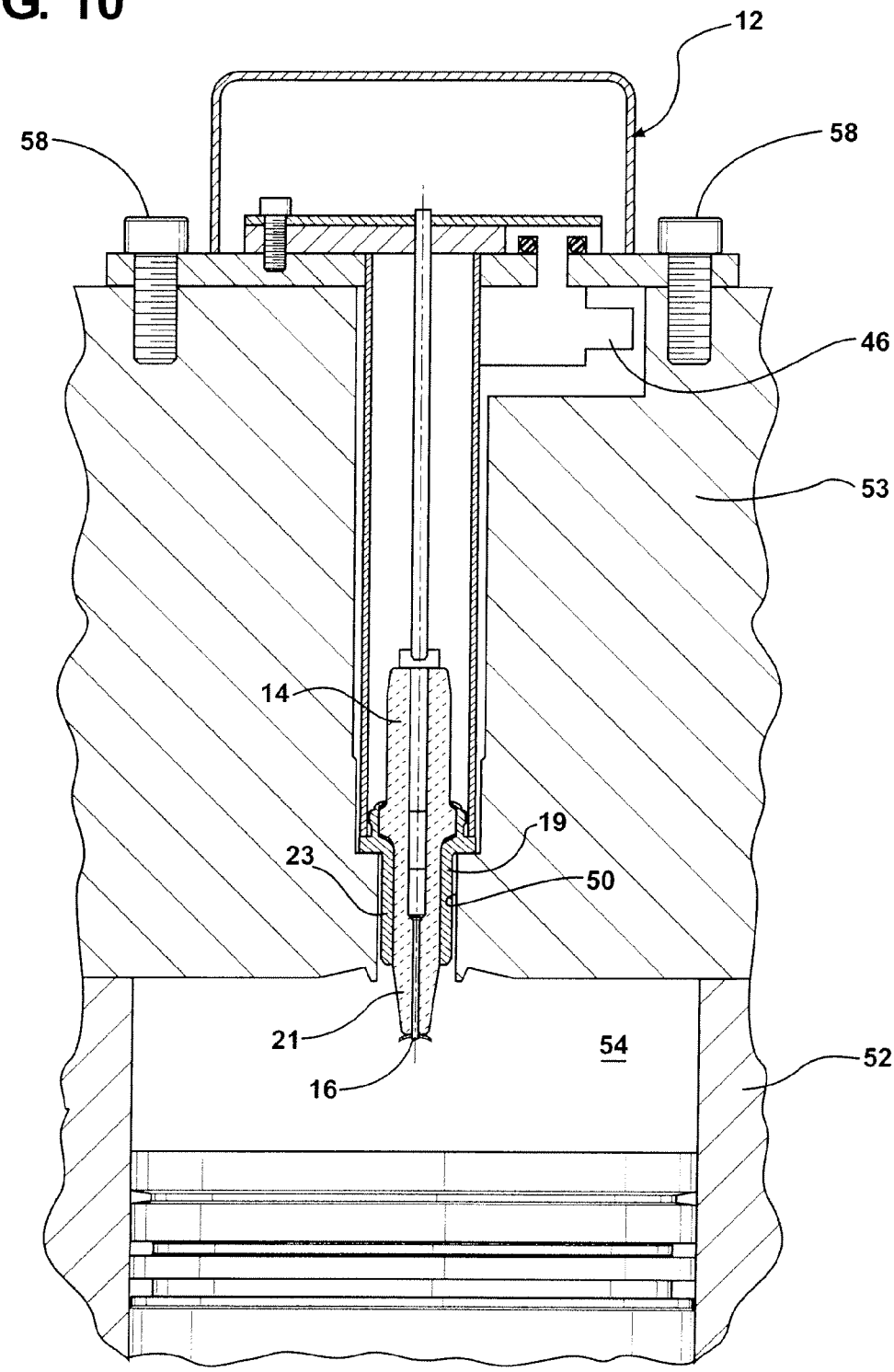
FIG. 10 is a view of the igniter shown in the installed position.

This invention is directed to a corona discharge fuel igniter system and methods for igniting fuel in an internal combustion engine that emit at least a partial corona discharge. The invention incorporates the use of particular insulator or dielectric materials that significantly increase the efficiency of corona discharge to ignite the fuel in an internal combustion engine. At the same time, the particular dielectric materials prolong the operation of the corona discharge fuel igniter system under the extreme temperature, stress and pressure conditions of the combustion environment.

The igniter system of this invention operates as a radio frequency (RF) device. Battery voltage is received by an electronic circuit and an amplified, radio frequency voltage is generated which is applied to the igniter. This igniter increases the RF voltage applied and a corona discharge is emitted from the fuel igniter system to ignite the fuel in the internal combustion engine. Thus, voltage that is provided to the corona electrical discharge fuel igniter is provided as RF voltage, at least a portion of the RF voltages passes through an electrical conductor that is connected with the electrical connector end of the fuel igniter and the corona discharge end of the igniter, and at least a part of that RF voltage is increased by the fuel igniter, e.g., by an inductor assembly portion of the fuel igniter. A corona discharge is emitted from the fuel igniter system to ignite the fuel in the internal combustion engine At least a portion of the electrical conductor is surrounded by a ceramic dielectric material that provides high corona discharge efficiency and is highly suited for fuel ignition environments. Preferably, at least a portion of the electrical conductor is further surrounded by a non-ceramic dielectric material and the ceramic and non-ceramic are in contact with one another.

The corona discharge fuel igniter system generally comprises an electrical connector end and a corona discharge end. An electrical conductor (e.g., metal wiring assembly) is connected to the electrical connector end and to the corona discharge end. At least one dielectric material comprised of a ceramic material surrounds the electrical conductor. Preferably, at least one non-ceramic material and at least one dielectric material surround the electrical conductor. Preferably, the non-ceramic dielectric material surrounds at least a portion of the electrical conductor at the electrical connector end, and the ceramic dielectric material surrounds the electrical conductor at the corona discharge end. It is also preferred that the ceramic material is in contact with the non-ceramic dielectric material.

The corona discharge fuel igniter system further includes an inductor assembly connected to the electrical conductor at the electrical connector end of the corona discharge fuel igniter system. The inductor assembly includes at least one inductor that increases RF voltage. Preferably, the inductor assembly includes resistance and inductance elements, more preferably resistance, inductance and capacitance elements.

Dielectric material surrounds the inductor assembly. Preferably non-ceramic dielectric material is used to surround the inductor assembly.

According to this invention, the term "ceramic" refers to sintered inorganic, nonmetallic materials, typically crystalline in nature, that are generally compounds formed between at least one metallic and one nonmetallic element or at least two different nonmetallic elements. Sintered material refers to material made from powder or particles in which the particles have been heated below their melting point until the particles adhere to one another or agglomerate. Examples of metals of this invention include standard metals of the Periodic Table, as well as aluminum, germanium, antimony and polonium. Examples of non-metals of this invention include standard non-metals of the Periodic Table, as well as boron, silicon, arsenic and tellurium.

A preferred ceramic material that is made of compounds formed between metallic and nonmetallic elements includes aluminum as at least one of the metal elements. Examples of such material include, but are not limited to, aluminum and oxygen (e.g., alumina-$Al_2O_3$), aluminum and nitrogen (e.g., aluminum nitride-AlN), and aluminum, oxygen and nitrogen (e.g., aluminum oxi-nitride). A preferred ceramic material that is made of compounds formed between at least two different nonmetallic elements includes silicon as at least one of the nonmetallic elements. Examples of such material include, but are not limited to, silicon and oxygen (e.g., silica-$SiO_2$), silicon and nitrogen (e.g., silicon nitride-$Si_3N_4$), and silicon, oxygen and nitrogen (e.g., SiAlON).

In one embodiment of the invention, the ceramic dielectric material is comprised of at least one oxide or nitride of aluminum or silicon. In a particular embodiment, at least a majority of the ceramic material is comprised of at least one oxide or nitride of aluminum or silicon, based on total weight of the ceramic material. Preferably at least 80 wt %, more preferably at least 90 wt %, still more preferably at least 95 wt %, still more preferably at least 98 wt %, and most preferably at least 99 wt % of the ceramic material is comprised of at least one oxide or nitride of aluminum or silicon, including combinations thereof, based on total weight of the ceramic material.

In a particularly preferred embodiment, the ceramic material is comprised of alumina and silica. Preferably, the ceramic contains alumina in an amount of from 95.0 wt % to 99.5 wt %, more preferably from 97.0 wt % to 99.5 wt %, and most preferably from 98.5 wt % to 99.5 wt %, based on total weight of the ceramic material. Preferably, the ceramic material further contains silica in an amount of from 0.1 wt % to 4.0 wt %, more preferably from 0.1 wt % to 3.0 wt %, more preferably from 0.2 wt % to 1.5 wt %, and most preferably from 0.3 wt % to 1.0 wt %, based on total weight of the ceramic material.

In preferred embodiments of the invention, the ceramic material is low in oxides and nitrides other than oxides or nitrides of alumina and silica, particularly in the case of silica and alumina containing ceramic material. Preferably, the ceramic material contains not greater than 5 wt %, more preferably not greater than 3 wt %, and most preferably not greater than 2 wt % of any oxide or nitride other than oxides or nitrides of aluminum or silicon. Particular examples of such oxides and nitrides include, but are not limited to, calcium oxide, magnesium oxide, zirconium oxide, and boron oxide, as well as boron nitride.

In particular embodiments of the invention, the ceramic material comprises at least one oxide of calcium, magnesium, zirconium or boron, but such oxides are preferably low in content. Having a low content of such oxides is particularly beneficial in lowering porosity and pore size of the ceramic material. Low porosity and pore size are beneficial in that likelihood of dielectric failure is reduced.

In one embodiment of the invention, the ceramic material includes calcium oxide (CaO). Preferably, the ceramic material includes calcium oxide in an amount of from 0.1 wt % to 2.0 wt %, more preferably from 0.2 wt % to 1.0 wt %, and most preferably from 0.3 wt % to 0.5 wt %, based on total weight of the ceramic material.

In one embodiment of the invention, the ceramic material includes magnesium oxide (MgO). Preferably, the ceramic material includes magnesium oxide in an amount of from 0.01 wt % to 0.5 wt %, more preferably from 0.02 wt % to 0.3 wt %, and most preferably from 0.03 wt % to 0.1 wt %, based on total weight of the ceramic material.

In one embodiment of the invention, the ceramic material includes zirconium oxide ($ZrO_2$). Preferably, the ceramic material includes zirconium oxide in an amount of from 0.01 wt % to 0.5 wt %, more preferably from 0.02 wt % to 0.3 wt %, and most preferably from 0.03 wt % to 0.2 wt %, based on total weight of the ceramic material.

In one embodiment of the invention, the ceramic material includes boron oxide ($B_2O_3$). Preferably, the ceramic material includes boron oxide in an amount of from 0.05 wt % to 0.5 wt %, more preferably from 0.1 wt % to 0.4 wt %, and most preferably from 0.2 wt % to 0.4 wt %, based on total weight of the ceramic material.

In one embodiment of the invention, it is preferred to have little if any boron nitride in the ceramic material. Preferably, the ceramic material has not greater than 5 wt %, more preferably not greater than 3 wt %, still more preferably not greater than 1 wt %, and most preferably not greater than 0.5 wt % boron nitride, based on total weight of the ceramic material.

In another embodiment of the invention, the ceramic material is comprised of at least one compound selected from the group consisting of aluminum oxides, aluminum nitrides, silicon oxides and silicon nitrides.

The ceramic used in this invention exhibits both highly desirable dielectric and mechanical properties at the particular conditions to which the material is exposed. The particular characteristics manufactured materials that confer the desired operating properties are provided in the description of the materials of this invention under standard temperature and pressure conditions, i.e., 25° C. and 1 atmosphere (101.3 KPa).

The ceramic used according to this invention is considered an insulator or dielectric in that it is a material that prevents the flow of an electrical current. The preferred ceramis is further characterized by having a relatively low dielectric constant. A dielectric constant is an index of the ability of a material to attenuate the transmission of an electrostatic force from one charged body to another. The lower the value, the greater the attenuation, or the better the ability of the material to serve as an electrical insulator.

In one embodiment, the ceramic material of this invention has a dielectric constant not greater than 11 at 1 MHz and 25° C. Preferably, the ceramic material has a dielectric constant not greater than 10, more preferably not greater than 9, and most preferably not greater than 8 at 1 MHz and 25° C.

The ceramic material also has a relatively high dielectric strength. Dielectric strength is the maximum electric field that an insulator or dielectric can withstand without breakdown. Generally at breakdown, a considerable current passes as an arc through the material which is accompanied by decomposition of the material along the path of the current.

In one embodiment, the ceramic material has a dielectric strength of at least 15 kV/mm. Preferably, the ceramic material has a dielectric strength of at least 17 kV/mm, more preferably at least 19 kV/mm.

The ceramic material that is used as a part of this invention has a low loss factor. The loss facto is a measure of the loss of energy in a dielectric material. The lower the loss factor, the lower the loss of energy.

In one embodiment, the ceramic material has a loss factor of not greater than 0.02 at 1 MHz and 25° C. Preferably, the ceramic material has a loss factor of not greater than 0.01, more preferably, not greater than 0.005 at 1 MHz and 25° C.

The ceramic material not only provides significant electric insulator characteristics but also exhibits highly durable mechanical properties. Such properties include tensile strength, MOR flexural strength and compressive strength.

The ceramic material has high tensile strength. Tensile strength is the ratio of the maximum load a material can support without fracture when being stretched to the original area of a cross section of the material. When stresses less than the tensile strength are removed, a material completely or partially returns to its original size and shape. In ceramic material, as the stress exceeds the tensile strength, the material breaks.

In one embodiment, the ceramic material has a tensile strength of at least 100 MPa. Preferably, the ceramic material has a tensile strength of at least 200 MPa, more preferably at least 300 MPa, and most preferably at least 400 MPa.

The ceramic material also has sufficient characteristics to avoid breakage, particularly at points of high torque contact. In this invention, the ceramic is high in MOR (modulus of rupture) transverse strength. MOR flexural strength is a measure of the ultimate load-carrying capacity of a material.

In one embodiment, the ceramic material has a MOR flexural strength of at least 100 MPa. Preferably, the ceramic material has a MOR flexural strength of at least 200 MPa, more preferably at least 400 MPa.

The ceramic material also has high compressive strength. Compressive strength is the capacity of a material to withstand axially directed pushing forces. When the limit of compressive strength is reached, materials are crushed.

In one embodiment of the invention, the ceramic material has a compressive strength of at least 500 MPa. Preferably, the ceramic material has a compressive strength of at least 1,000 MPa, more preferably at least 1,500 MPa.

The ceramic material of this invention preferably has a low internal porosity and relatively small pore size. Such characteristics are particularly favorable in reducing the likelihood of dielectric failure.

Preferably, the ceramic material has an internal porosity of not greater than 2%. More preferably, the ceramic material has an internal porosity of not greater than 1.5%, and still more preferably not greater than 1.0%.

The ceramic material preferably has a median pore size of not greater than 3 microns. Preferably, the ceramic material has a median pore size of not greater than 2.5 microns, and still more preferably not greater than 2 microns.

It is preferred that the range of pore sizes in the ceramic material not be great, and therefore the maximum pore size not be too large. Preferably, at least 90 wt % of the ceramic material used in the igniter of this invention has a maximum pore size of not greater than 15 microns, more preferably not greater than 12 microns, and most preferably not greater than 10 microns.

The size of the pores in the ceramic material can be reduced by reducing the particle size of the ceramic powder precursor used to make the ceramic material. Preferably, the ceramic material is the sintered product of a ceramic powder precursor having an average particle size of not greater than 2 microns, more preferably not greater than 1.5 microns.

It is also preferred that the ceramic powder precursor used to make the ceramic material have a relatively high surface area. Preferably, the ceramic material is the sintered product of a ceramic powder precursor having an average surface area (BET) of at least 1.5 $m^2/g$, more preferably at least 2.0 $m^2/g$, and still more preferably at least 3.0 $m^2/g$.

The ceramic material incorporated into this invention has a high thermal conductivity to reduce pre-ignition. Preferably, the ceramic material has a thermal conductivity of at least 25 W/M-K at 25° C., more preferably at least 30 W/M-K, and most preferably at least 35 W/M-K at 25° C.

The non-ceramic dielectric material of this invention can be any non-ceramic dielectric material that provides sufficient dielectric properties to sufficiently isolate high voltage from grounding. Such materials include gas, resin and polymer dielectric materials. At least a portion of the non-ceramic will generally be outside the direct combustion location or housing, whereas the ceramic can be located directly at the point of combustion. As with the description of characteristics of the ceramic material, examples of characteristics desired in the non-ceramic materials are described herein at standard temperature and pressure conditions, i.e., 25° C. and 1 atmosphere (101.3 KPa).

According to one embodiment of the invention, the non-ceramic dielectric material has a dielectric constant different from that of the ceramic dielectric material. In another embodiment, embodiment of the invention, the non-ceramic dielectric material has a dielectric constant less than that of the ceramic dielectric material. In one embodiment, the dielectric constant of the non-ceramic material will be at least 1, at least 2, at least 4, or at least 6 less than that of the ceramic material at 1 MHz and 25° C.

In a preferred embodiment of the invention the non-ceramic material has a dielectric constant of not greater than 11 at 1 MHz and 25° C. Preferably, the non-ceramic material has a dielectric constant of not greater than 9, more preferably not greater than 7, and most preferably not greater than 5 at 1 MHz and 25° C.

The igniter system can include more than one type of non-ceramic dielectric material. For example, the igniter system can include more than one non-ceramic dielectric material, with any combination of gas, resin or polymer dielectric. Each of these materials are preferably arranged to be in contact with one another such that grounding is minimized, and at least one non-ceramic dielectric is in contact with at least one ceramic dielectric material, with the ceramic dielectric material being located at the corona discharge end of the igniter system.

An example of one type of igniter system is shown in FIGS. 1-10. A corona discharge fuel igniter system 10 according to one aspect of the invention includes an insulator 14 fabricated of either aluminum oxide (alumina), silicon nitride or aluminum nitride. The high dielectric strength, high electric resistivity and low dielectric constant of alumina meet the electrical performance requirements of an insulator for a corona discharge igniter. Alumina also has a high mechanical strength that is needed so that the insulator does not brake during assembly of the igniter or during service in an internal combustion engine. Silicon nitride also meets these requirements, as does aluminum nitride, but are more costly than alumina.

The drawings show one embodiment of a corona discharge fuel igniter system 10 having the subject insulator. The igniter includes a corona discharge assembly 12, an electrode wire 16 accommodated within and extending from a lower end 18 of the insulator 14; a metal shell 19 surrounding a middle portion of the insulator 14 such that a lower portion 21 of the insulator 14 projects out of a lower end 23 of the shell, a terminal 20 accommodated within and extending from an upper end 22 of the insulator 14, a metal tube 24 welded at one end 26 to the shell 19, and welded to a flange 28 at the opposite end 30. A connecting wire 32 extends within the tube 24 from the terminal 20, through an opening 34 in the flange 28 and is connected to an inductor assembly 36 which is mounted by intervening insulating pads 38 on the flange 28. A metal cover 40 surrounds the inductor assembly 36 and is welded to the flange 28 to provide a sealed environment 42. Electrical terminals 44 are attached to the inductor assembly 36 and pass through the flange 28 to a connector 46 extending radially outwardly for external connection. The flange 28 has a fill opening 48 for the introduction of pressurized fill gas into the sealed space 42 of the corona discharge fuel igniter system 10, after which the fill opening 48 is sealed closed.

The corona discharge assembly 12 of the corona discharge fuel igniter system 10, and particularly the metal shell 19 that extends into the igniter opening 50 into the block 52 and combustion chamber 54 is free of external mounting threads, as may be the igniter opening 50. This allows the insulator 14 including the lower portion 21 extending into the combustion chamber 54 to be increased in size, or the opening to be decreased, or both. In lieu of the mounting threads, the corona discharge fuel igniter system 10 provides one or more mounting holes 56 in the flange 28 through which fasteners 58 can be received for mounting the corona discharge fuel igniter system 10 to the cylinder head 53 independently of the unthreaded head end 23.

Figure 11:
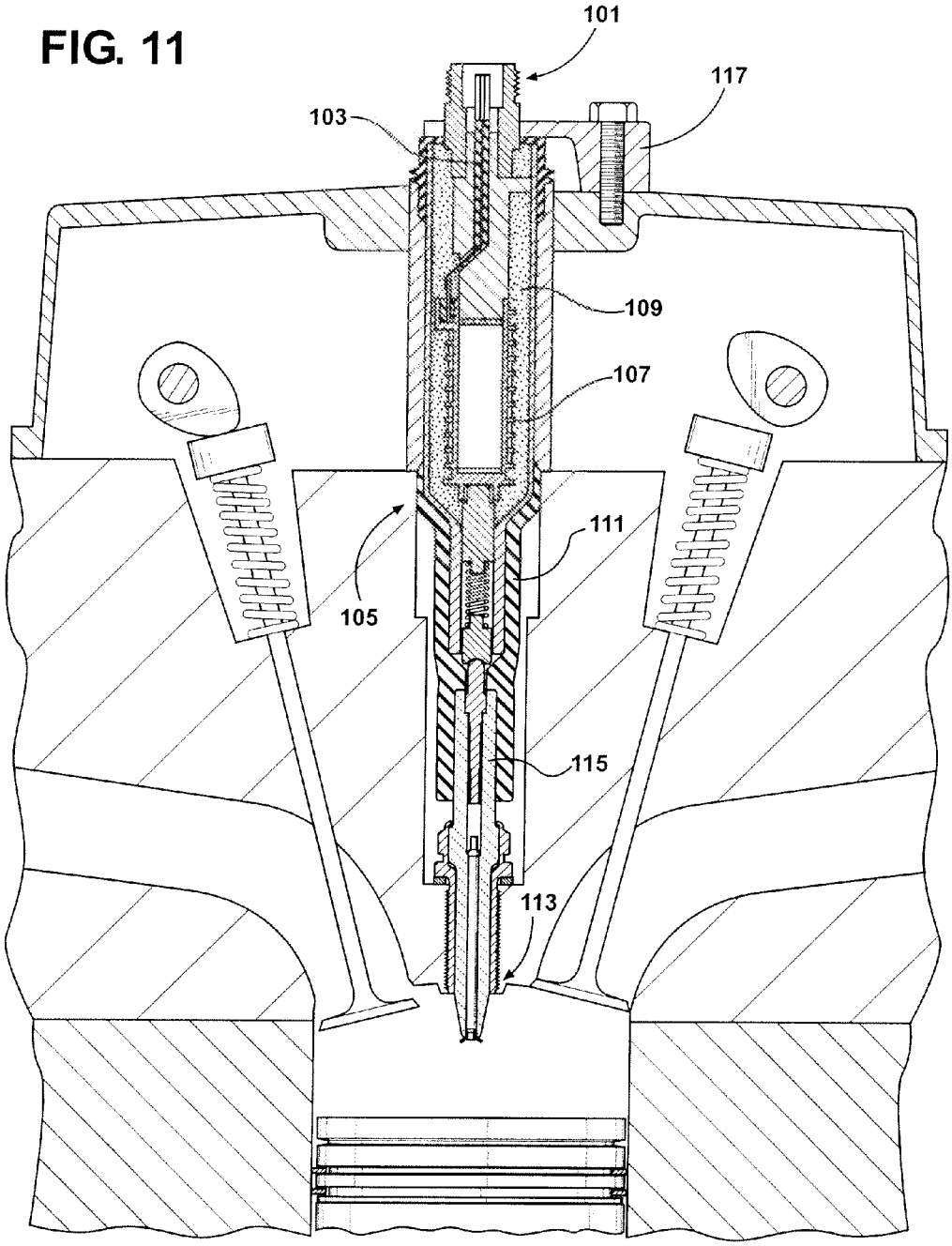
FIG. 11 is a cross-sectional view of an igniter fabricated according to another embodiment of the invention in the installed position.

Another example of an igniter system of this invention is shown in FIG. 11. The igniter includes a corona discharge assembly having an electrical connector end 101 to which an electrical conductor or wire 103 is attached. An inductor assembly 105 is connected to the electrical conductor 103. The inductor assembly 105 includes inductor windings 107.

The inductor assembly 105 is surrounded by a first non-ceramic dielectric material 109, which is a resin dielectric material. The inductor assembly 105 is also surrounded by a second non-ceramic dielectric material 111 of silicone rubber.

The corona discharge fuel igniter system further includes a corona discharge end 113. At the corona discharge end 113 is a ceramic dielectric insulator 115 that surrounds the electrical conductor 103.

The corona discharge fuel igniter system in FIG. 11 is shown in an internal combustion engine head with a cam cover and combustion chamber. The igniter system is held in place by holddown flange 117. Current is passed through the conductor 103, with corona streamers being emitted from the corona discharge end 113 to ignite fuel in the combustion chamber.

The principles and modes of operation of this invention have been described above with reference to various exemplary and preferred embodiments. As understood by those of skill in the art, the overall invention, as defined by the claims, encompasses other preferred embodiments not specifically enumerated herein.

The invention claimed is:

1. A corona discharge fuel igniter system, comprising:
- electrical connector end;
- corona discharge end;
- electrical conductor connecting the electrical connector end to the corona discharge end;
- inductor assembly connected to the electrical conductor at the electrical connector end;
- non-ceramic dielectric material surrounding the electrical conductor and inductor assembly at the electrical connector end, the non-ceramic dielectric material comprised of pressurized gas;
- ceramic dielectric material in contact with the non-ceramic dielectric material and surrounding the electrical conductor at the corona discharge end; and
- the ceramic dielectric material including at least one oxide or nitride of aluminum or silicon.

2. The corona discharge fuel igniter system of claim 1, wherein the inductor assembly includes at least one inductor.

3. The corona discharge fuel igniter system of claim 1, wherein the inductor assembly includes resistance and inductance elements.

4. The corona discharge fuel igniter system of claim 1, wherein the inductor assembly includes resistance, inductance and capacitance elements.

5. The corona discharge fuel igniter system of claim 1, wherein the ceramic dielectric material has a dielectric constant different from that of the non-ceramic dielectric material.

6. The corona discharge fuel igniter system of claim 1, wherein the ceramic dielectric material is a sintered inorganic, nonmetallic material comprised of compounds formed between at least one metallic and one nonmetallic element or compounds of at least two different nonmetallic elements.

7. The corona discharge fuel igniter system of claim 1, wherein the ceramic dielectric material is comprised of alumina and silica.

8. The corona discharge fuel igniter system of claim 1, wherein the ceramic dielectric material is comprised of not greater than 5 wt % of at least one oxide of calcium, magnesium, zirconium or boron.

9. The corona discharge fuel igniter system of claim 1, wherein the non-ceramic dielectric material has a dielectric constant different from that of the ceramic dielectric material.

10. The corona discharge fuel igniter system of claim 8, wherein the ceramic dielectric material is comprised of at least 0.1 wt % of at least one oxide of calcium, magnesium, zirconium or boron.

11. The corona discharge fuel igniter system of claim 1, wherein at least 80 wt % of the ceramic dielectric material is comprised of at least one oxide or nitride of aluminum or silicon.

12. The corona discharge fuel igniter system of claim 1, wherein the ceramic dielectric material includes alumina in an amount of from 95.0 wt % to 99.5 wt % and silica in an amount of from 0.1 wt % to 4.0 wt %, based on the total weight of the ceramic material.

13. The corona discharge fuel igniter system of claim 1, wherein the ceramic dielectric material includes alumina in an amount of from 95.0 wt % to 99.5 wt %, silica in an amount of from 0.1 to 4.0 wt %, calcium oxide in an amount of from 0.1 wt % to 2.0 wt %, magnesium oxide in an amount of from 0.01 wt % to 0.5 wt %, and zirconium oxide in an amount of from 0.01 wt % to 0.5 wt %, based on the total weight of the ceramic material.

14. The corona discharge fuel igniter system of claim 1, wherein the ceramic dielectric material includes alumina in an amount of at least 99.5 wt % and magnesium oxide in an amount of from 0.01 wt % to 0.5 wt %, based on the total weight of the ceramic material.

15. The corona discharge fuel igniter system of claim 1, wherein the ceramic dielectric material includes silicon nitride in an amount of at least 90.0 wt %, based on the total weight of the ceramic material, and alumina.

16. The corona discharge fuel igniter system of claim 1, wherein the ceramic dielectric material is comprised of alumina and silicon nitride.

17. The corona discharge fuel igniter system of claim 1, wherein the ceramic dielectric material is comprised of silicon nitride.

18. A method for igniting fuel in an internal combustion engine, comprising:
- providing electrical current to a corona discharge fuel igniter system;
- passing at least a portion of the electrical current through the fuel igniter system in the form of radio frequency voltage by way of an electrical conductor in the fuel igniter system;
- surrounding at least a portion of the electrical conductor with a non-ceramic dielectric material comprised of pressurized gas as the current passes through the conductor;
- surrounding at least a portion of the electrical conductor with a ceramic dielectric material comprised of at least one oxide or nitride of aluminum or silicon as the current passes through the conductor; and
- emitting a corona discharge from the fuel igniter system to ignite the fuel in the internal combustion engine.

19. The method of claim 18, wherein radio frequency voltage is provided as the electrical current.

20. The method of claim 19, wherein the inductor assembly includes resistance and inductance elements.

21. The method of claim 19, wherein the inductor assembly includes resistance, inductance and capacitance elements.

22. The method of claim 18 including connecting the non-ceramic dielectric material to the ceramic dielectric material.

23. The method of claim 18, wherein the non-ceramic dielectric material has a dielectric constant different from that of the ceramic dielectric material.

24. The method of claim 18, wherein the ceramic dielectric material is comprised of alumina and silica.

25. The method of claim 18, wherein the ceramic dielectric material is comprised of not greater than 5 wt % of at least one oxide of calcium, magnesium, zirconium or boron.

26. A corona discharge fuel igniter system, comprising:

electrical connector end;

corona discharge end;

electrical conductor connecting the electrical connector end to the corona discharge end;

inductor assembly connected to the electrical conductor at the electrical connector end;

first non-ceramic dielectric material surrounding the electrical conductor and inductor assembly at the electrical connector end, the first non-ceramic dielectric material comprised of at least one resin, polymer, or pressurized gas;

ceramic dielectric material in contact with the first non-ceramic dielectric material and surrounding the electrical conductor at the corona discharge end;

the ceramic dielectric material including at least one oxide or nitride of aluminum or silicon; and second non-ceramic dielectric material surrounding the first non-ceramic dielectric material, the second dielectric material comprised of rubber.

* * * * *